US009056748B2

(12) United States Patent
Sears

(10) Patent No.: US 9,056,748 B2
(45) Date of Patent: Jun. 16, 2015

(54) LIFTING SYSTEM AND METHOD

(71) Applicant: Richard L. Sears, Weatherford, TX (US)

(72) Inventor: Richard L. Sears, Weatherford, TX (US)

( * ) Notice: Subject to any disclaimer, the term of this patent is extended or adjusted under 35 U.S.C. 154(b) by 274 days.

(21) Appl. No.: 13/650,243

(22) Filed: Oct. 12, 2012

(65) Prior Publication Data

US 2013/0269163 A1 Oct. 17, 2013

Related U.S. Application Data

(60) Provisional application No. 61/546,120, filed on Oct. 12, 2011.

(51) Int. Cl.

| | |
|---|---|
| ***B66D 1/36*** | (2006.01) |
| ***B66B 11/08*** | (2006.01) |
| ***B66D 3/04*** | (2006.01) |

(52) U.S. Cl.

CPC ..... *B66B 11/08* (2013.01); *Y10T 29/49815* (2015.01); *Y10T 29/49817* (2015.01); *B66D 3/04* (2013.01)

(58) Field of Classification Search

USPC ..... 254/325, 327, 338

See application file for complete search history.

(56) References Cited

U.S. PATENT DOCUMENTS

| | | | | |
|---|---|---|---|---|
| 1,461,650 | A | 7/1923 | Falzer et al. | |
| 2,815,927 | A | 12/1957 | Howard | |
| 2,833,423 | A | 5/1958 | Tucker | |
| 4,065,102 | A | 12/1977 | Johnson et al. | |
| 4,858,890 | A | 8/1989 | Fowler et al. | |
| 5,056,673 | A | 10/1991 | Williams | |
| 5,123,131 | A * | 6/1992 | Jandrakovic | 5/85.1 |
| 5,482,169 | A | 1/1996 | Simon et al. | |
| 5,765,809 | A | 6/1998 | Baker et al. | |
| 6,041,949 | A | 3/2000 | Walker et al. | |
| 6,152,427 | A * | 11/2000 | Hoslett | 254/338 |
| 6,161,702 | A * | 12/2000 | Campbell | 211/17 |
| 6,386,515 | B1 * | 5/2002 | Sachtleben | 254/338 |
| 6,478,172 | B2 | 11/2002 | Zingerman | |
| 7,189,047 | B2 | 3/2007 | Kuipers et al. | |
| 7,311,297 | B1 * | 12/2007 | Bradshaw et al. | 254/272 |
| 7,407,039 | B2 | 8/2008 | Bailey | |
| 7,543,799 | B2 * | 6/2009 | Willis et al. | 254/336 |
| 7,604,134 | B2 | 10/2009 | Lichinchi | |
| 8,056,883 | B1 * | 11/2011 | Brockie | 254/278 |
| 2004/0238472 | A1 | 12/2004 | Varidenger et al. | |
| 2005/0191165 | A1 * | 9/2005 | Willis et al. | 414/803 |

(Continued)

*Primary Examiner* — Emmanuel M Marcelo

(74) *Attorney, Agent, or Firm* — Decker Jones PC; Brian K. Yost; Geoffrey A. Mantooth

(57) ABSTRACT

The lifting system and method comprises a winch and pulley system, the pulleys being adapted to be mounted to a wall of a structure, the winch being mounted to a tube assembly, said tube assembly comprising a tube and winch plate, wherein said tube is slideably and removably coupled to a receiver portion such that the winch may be removed when not in use or may be moved to be used in another system; wherein said receiver portion is coupled to a substructure upon which a cooler structure is mounted; wherein, a first pulley is mounted to an outside wall of said structure; wherein said second pulley is positioned at an end of a lifting arm, said arm being coupled to an inside wall of the structure; wherein a through opening is provided in said wall so that a winch cable may be threaded from the winch outside the structure, through the first pulley, through said wall opening, and over said second pulley; and wherein an end of said cable may be secured to a motor in the interior of said structure.

16 Claims, 11 Drawing Sheets

(56) References Cited

U.S. PATENT DOCUMENTS

| | | | | |
|---|---|---|---|---|
| 2005/0236352 | A1 | 10/2005 | Tien | |
| 2006/0163186 | A1 | 7/2006 | Chote et al. | |
| 2009/0095944 | A1 | 4/2009 | Gaines | |
| 2010/0104365 | A1* | 4/2010 | Wood et al. | 405/3 |
| 2012/0090921 | A1* | 4/2012 | Janz | 187/216 |
| 2013/0214224 | A1* | 8/2013 | Byers | 254/272 |

* cited by examiner

LIFTING SYSTEM AND METHOD

This application claims the benefit of provisional application Ser. No. 61/546,120 filed Oct. 12, 2011, the contents of which are incorporated by reference herein its entirety.

BACKGROUND OF THE INVENTION

1. Field of the Invention

The present invention generally relates to a system and method for lifting objects confined within a limited access space, and specifically to a system and method for lifting a heat exchange cooler motor in a natural gas processing facility.

2. Background of the Invention

In the course of processing natural gas in natural gas processing facilities, large heat exchanges or coolers are utilized. These coolers are comprised with structures that support large motors which drive fans. From time to time, these motors must be serviced and/or replaced. Because of the physical constraints of the cooler structure, removal of the motor is both time consuming and labor intensive.

The present disclosure provides a system and method which facilitates the servicing of cooler motors in gas processing facilities. The lifting system comprises a winch and pulley assembly, the pulleys being adapted to be mounted to a wall of the structure.

The lifting system comprises a removable winch and a dedicated pulley system. The winch is mounted to a winch plate which is adapted to be slideably and removably coupled to a receiver portion. This arrangement allows the winch to be removed when not in use. Or, the winch may easily be moved to another system. The receiver portion is coupled to a substructure supported by the cooler structure. A first pulley is mounted to an outside wall of the cooler structure. A second pulley is positioned at the end of a lifting arm which is coupled to an inside wall of the cooler structure. An opening is provided in the wall so that a winch cable may be threaded from the winch outside the structure, through the first pulley, through the wall opening to the interior of the structure, and over the second pulley, the end of the cable may then be secured to the motor. The motor can then be supported so that it may be disconnected from the cooler structure.

3. Description of the Prior Art

There have been a number of other patents and patent publication that teach lifting devices. For example, Falzer U.S. Pat. No. 1,461,650 teaches a lifting machine which may be used for raising equipment on a caisson or well and comprises a tripod having its apex approximately in line of the center or axis of the hole.

Howard U.S. Pat. No. 2,815,927 teaches a hoist which may be used to lift material along the longitudinal axis of an overhead track as well as materials that are beyond the end of the track. The Howard device comprises a rigid frame mounted on wheels for movement along an overhead track. The sheave housing may swing about a horizontal or vertical axis so as to allow the hoist to be used on objects outside the axis of the track and beyond its end.

Tucker U.S. Pat. No. 2,833,423 teaches a hoisting device which may be mounted to a vertical structure such as a telephone pole and which may be used to lift a heavy object such as a transformer.

Johnson U.S. Pat. No. 4,065,102 teaches a device which may be mounted to a structure such as a printing press frame to allow a hoist to lift rollers within the structure. The device is mound to the frame by means of an L-shaped. The device further comprises an extension arm and triangular shaped gussets or braces which allow the hoist to extend the line to lift objects within the frame.

Fowler U.S. Pat. No. 4,858,890 teaches a hoist and method for lifting objects inside a vessel having a platform on the exterior wall. The device is mounted to a frame on the outside of the vessel and comprises a cantilevered portion that extends through the wall of the vessel through an inspection port.

Williams U.S. Pat. No. 5,056,673 teaches a hoist for lifting electrical equipment such as transformers. The device is removably mounted to a pole.

Simon U.S. Pat. No. 5,482,169 teaches a lifting device which may be used in an enclosure which is inaccessible to operators such as tight cells or chambers used in the nuclear field for confining radioactive materials. The device comprises a main arm which may be inserted through hole within a sleeve to allow the operator to move objects found within the enclosure while the operator is outside the enclosure. The apparatus is supported by the shield 1 and wall frame of the shield.

Baker U.S. Pat. No. 5,765,809 teaches a device for lifting items. The device may be mounted on a particular piece of equipment. The device comprises a receiver which may be welded to the base of the machinery. The receiver allows the vertical piece to rotate. The vertical piece is attached to a generally horizontal hollow pipe which may comprise two separate hollow pipes.

Walker U.S. Pat. No. 6,041,949 teaches an overhead lifting device for use in lifting an electrical switching apparatus. The device comprises a moveable support frame which moves along first and second rail members mounted to the electrical cabinet.

Zingeman U.S. Pat. No. 6,478,172 teaches a portable lifting device which may be used to lift heavy objects through a window or opening in a structure. The apparatus includes a trolley installed in a girder. The frame is connected to the telescopic posts which support the assembly within the structure. The girder allows the trolley to move material from outside the building to inside the building.

Kuipers U.S. Pat. No. 7,189,047 teaches an apparatus for moving a battery. The apparatus is mounted to a shelf which contains batteries.

Bailey U.S. Pat. No. 7,407,039 teaches a portable lifting device which may be mounted to the outside of the structure.

Lichinchi U.S. Pat. No. 7,604,134 teaches a portable knock down trolley hoist which may be used to lift heavy objects. The hoist comprises an overhead trolley support member having a top portion and bottom portion in a trolley mounted on roller bearings that allow the trolley to be moved from a position along the rail.

Gaines Patent Publication US2009/0095944 teaches a lifting apparatus which may be mounted to a permanently affixed ladder (see Gaines FIG. 5). The device comprises a hoist mounted on a mast which extends through a hatch opening in the roof of a building.

Varildengen Patent Publication US2004/0238472 teaches a hoist which may be mounted to a window opening, shell of a building, etc. and comprises a central post portion (see Varildengen FIG. 1) to which the hoist may be mounted.

Tien Patent Publication US2005/0236352 teaches a portable crane that can be set up on a rooftop.

Choate Patent Publication US2006/0163186 teaches a hoisting device which may be used in securing a person working in elevation. The device may be mounted on a base comprising leveling screws and casters.

As may be noted, none of the foregoing references teach the lifting device and method of the present invention. Specifically, none of the references teach a device comprising an outer portion mounted to an outer wall of a structure, an inner portion mounted to an inner wall of a structure which allows a winch, mounted on the outside of the structure, to operate outside the building and lift objects within the structure.

SUMMARY OF THE INVENTION

A lifting system is provided comprising an outer portion mounted an outer wall of a structure, an inner portion mounted to an inner wall of a structure which allows a winch, positioned on the outside of the structure, to lift objects within the structure.

In a preferred embodiment, the lifting system comprises a winch and pulley system. The pulleys are adapted to be mounted to a wall of the structure. The winch is mounted to a tube assembly. The tube assembly comprises a tube and winch plate. The tube is slideably and removably coupled to a receiver such that the winch may be removed when not in use or may be moved to be used in another system. The receiver is coupled to a substructure supported by a cooler structure. A first pulley is mounted to an outside wall of the structure. The said second pulley is positioned at an end of a lifting arm and is coupled to an inside wall of the structure. A through opening in the wall permits a winch cable to be threaded from the winch outside the structure, through the first pulley, through the wall opening, and over the second pulley. An end of the cable may be secured to the motor in the interior of the structure.

In another embodiment, the lifting system is adapted for use in structures that have reduced clearances such that pulleys cannot be mounted to certain surfaces of the wall. In this embodiment, the lifting system comprises a horizontal member, a coupling adaptor, a receiver portion, a tube assembly, and a winch. The horizontal member comprises one or more pulleys.

A method of removing a motor from within a limited access space is provided. The method comprises the steps of: providing a lifting system comprising a winch and pulley system, the pulleys being adapted to be mounted to a wall of the structure, the winch being mounted to a winch plate slideably and removably coupled to a receiver portion such that the winch may be removed when not in use or may be moved to be used in another system; wherein said receiver portion is coupled to a substructure of the cooler structure; wherein, a first pulley is mounted to an outside wall of said structure; wherein said second pulley is positioned at an end of a lifting arm, said arm being coupled to an inside wall of the structure; wherein an opening is provided in said wall so that a winch cable may be threaded from the winch outside the structure, through the first pulley, through said wall opening, and over said second pulley; and wherein an end of said cable may be secured to the motor in the interior of said structure; threading said cable through said first pulley and opening and over said second pulley; securing the cable to the motor; activating the winch such that the motor is partially lifted; removing a support structure that secures the motor in place; further lowering the motor so that it can be moved outside the structure; and replacing the motor with a replacement motor using the winch in a reverse sequence used in removing the motor.

In another embodiment, the method of removing a motor from within a limited access space comprises the steps of: providing a lifting system comprising a horizontal member, a coupling adaptor, a receiver portion, a tube assembly, and a winch, said tube assembly comprising a tube and winch plate, the horizontal member comprising one or more pulleys, the coupling adaptor being adapted for coupling to a structure, the winch being mounted to a winch plate slideably and removably coupled to a receiver portion such that the winch may be removed when not in use or may be moved to be used in another system; wherein said receiver portion is coupled to a substructure upon which a cooler structure is mounted; threading a cable through a first pulley and over a second pulley; securing the cable to the motor; activating the winch such that the motor is partially lifted; removing a support structure that secures the motor in place; further lowering the motor so that it can be moved outside the structure; and replacing the motor with a replacement motor using the winch in a reverse sequence used in removing the motor.

In other embodiments, a lifting cage is provided. The cage comprises upper and lower retaining portions, sides, and a connector portion. The sides span between the upper and lower portions. The cage is adapted to be removably coupled to the motor. The motor may be supported by lifting the cage with the connector portion.

In one embodiment the cage side portions comprise a plurality of rods.

In one embodiment a motor stand is provided.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention in the drawings.

DESCRIPTION OF THE PREFERRED EMBODIMENT

Figure 1:
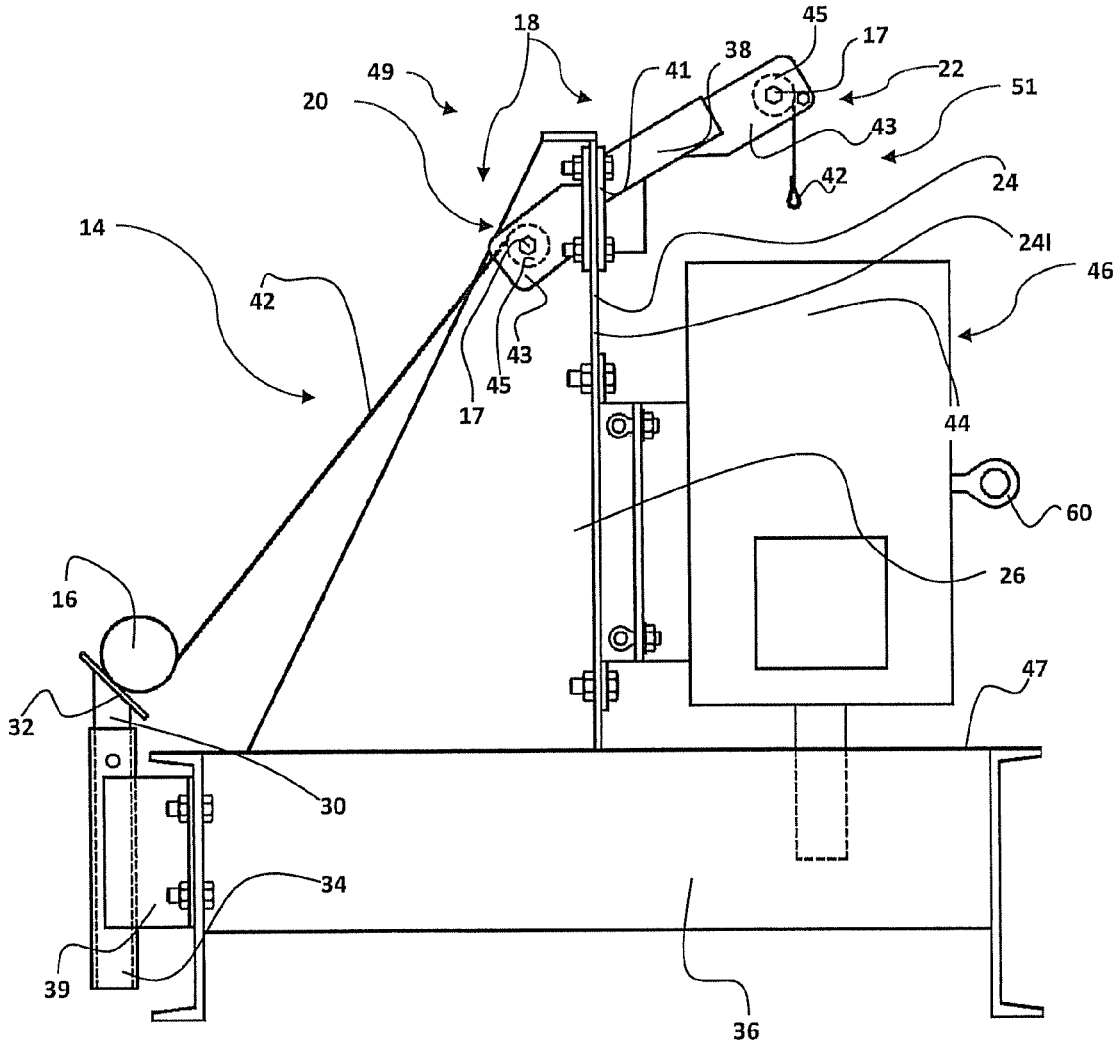
FIG. 1 is a side elevation view of the lifting system in accordance with a preferred embodiment.
Figure 2A:
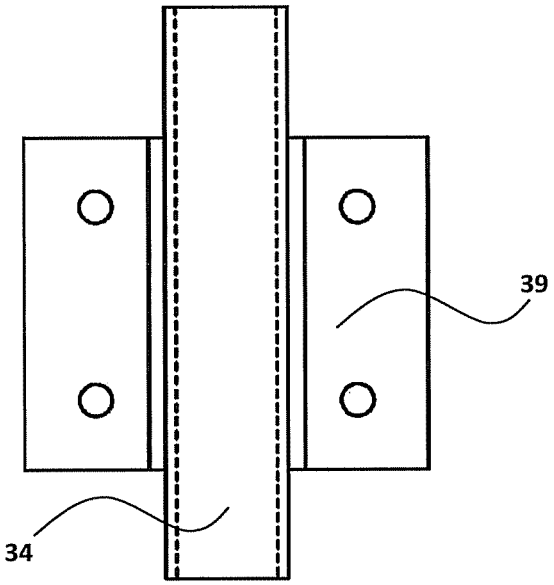
FIG. 2A is a front view of the receiver assembly in accordance with a preferred embodiment.
Figure 2B:
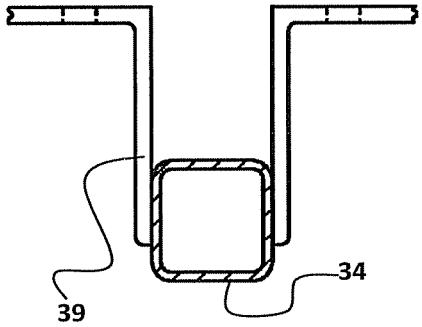
FIG. 2B is a top view of the receiver assembly in accordance with a preferred embodiment.
Figure 2C:
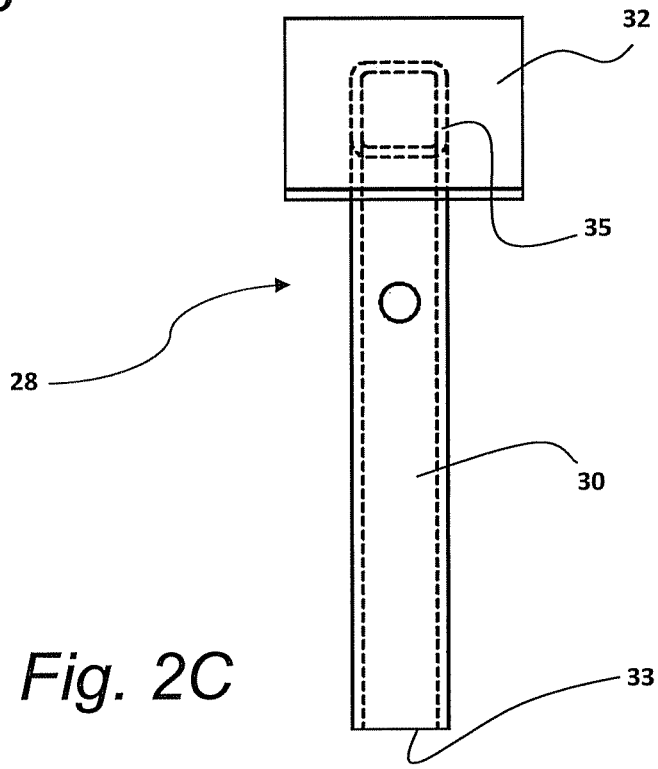
FIG. 2C is a front view of the tube assembly in accordance with a preferred embodiment.
Figure 3A:
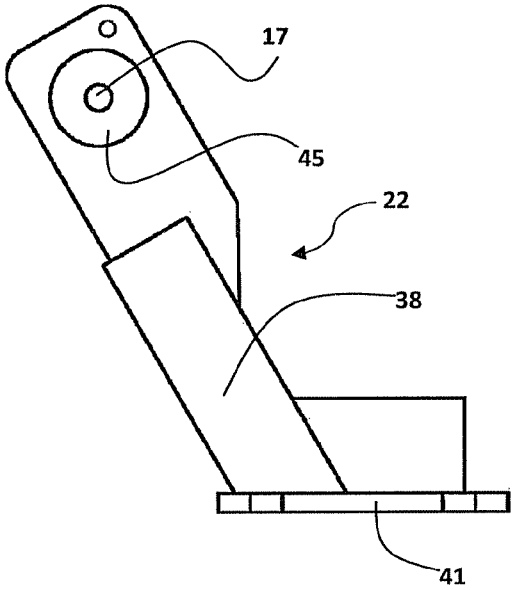
FIG. 3A is a side elevation view of the motor side pulley assembly of the system in accordance with a preferred embodiment.
Figure 3B:
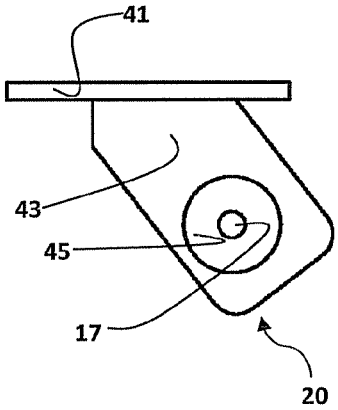
FIG. 3B is a side elevation view of the winch side pulley assembly of the system in accordance with a preferred embodiment.
Figure 3C:
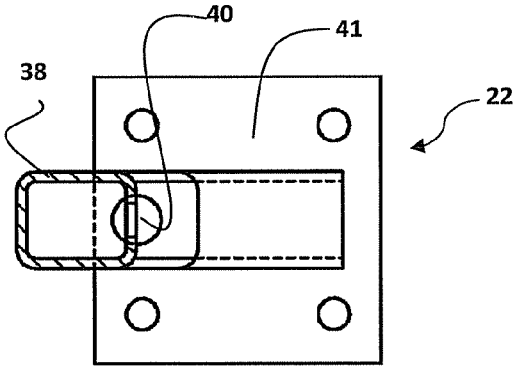
FIG. 3C is a front elevation view of a portion of the motor side pulley assembly of the system in accordance with a preferred embodiment.
Figure 3D:
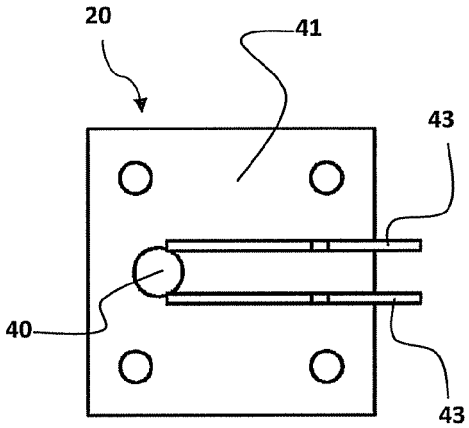
FIG. 3D is a front elevation view of a portion of the winch side pulley assembly of the system in accordance with a preferred embodiment.

Referring to FIGS. 1-11, a lifting system 14 is shown. In describing the embodiments of the invention illustrated in the drawings, specific terminology will be used for the sake of clarity. However, the invention is not intended to be limited to the specific terms so selected, it being understood that each specific term includes all technical equivalents operating in similar manner to accomplish similar purpose. It is understood that the drawings are not drawn exactly to scale. In the drawings, similar reference numbers are used for designating similar elements throughout the several drawings.

The following describes particular embodiments of the invention. However, it should be understood, based on this disclosure, that the invention is not limited to the embodiments detailed herein. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

The examples and illustrations of a system and method for a lifting are described herein with respect to removing a motor from a cooler assembly. However, the inventive system is equally applicable for use with other devices and other structures. Moreover, while certain materials are discussed herein with respect to the components of the system, adaptor, etc., the system is not limited to such materials. In the preferred embodiment of the lifting system, certain components are formed from steel. However, the components of the system may comprise any suitable materials without departing from the scope and spirit of this disclosure.

Referring to the figures, in a preferred embodiment, the lifting system 14 generally comprises a winch 16 and pulley system 18. The pulley system 18 comprises pulley assemblies 20, 22 adapted to be mounted to a wall 24 of a structure 26. In the preferred embodiment, the structure 26 is a structure 26 commonly found in natural gas processing facilities for housing large heat exchangers or coolers and large motors 44 which drive fans. Although the structure 26 of the preferred embodiment is a natural gas processing facility cooling structure 26, the principles of the present invention may be applied and the system used in other structures 26.

Figure 6:
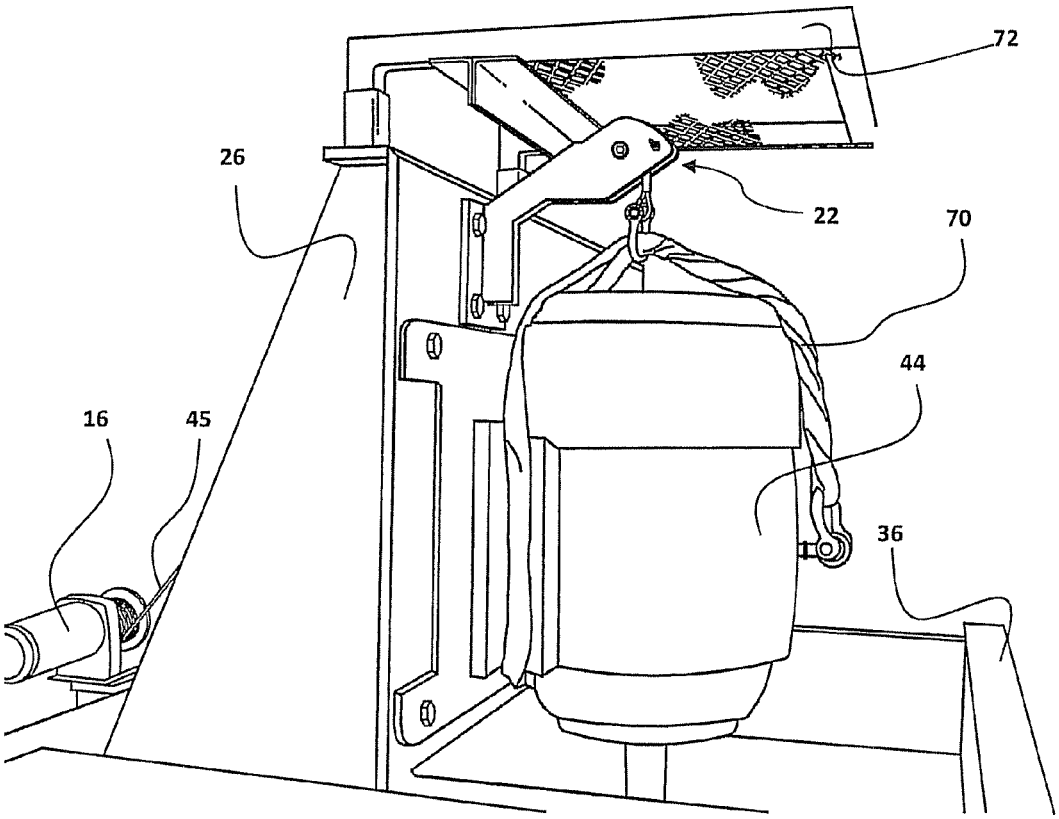
FIG. 6 is a side and motor side view of the system with the motor attached to the cable with limited access simulated in accordance with a preferred embodiment.
Figure 7:
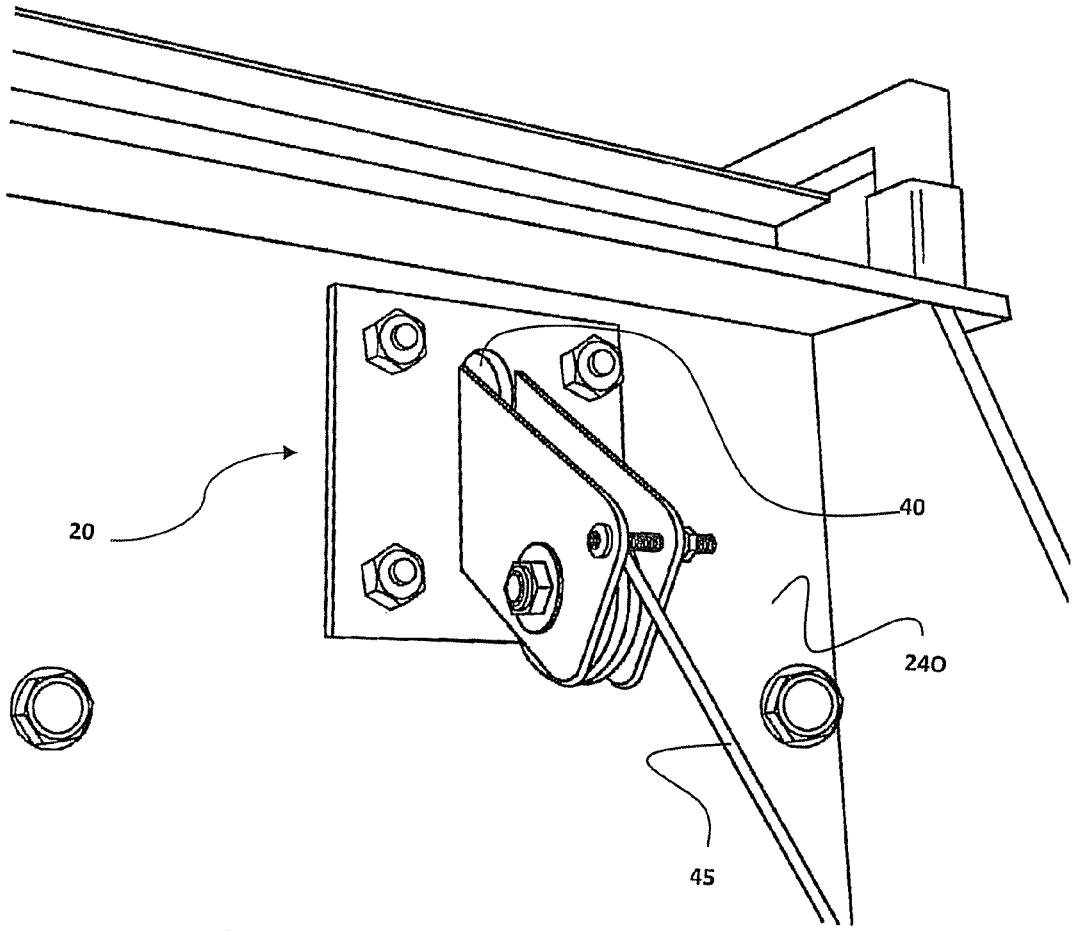
FIG. 7 is winch side view showing the winch side sheave attachment and pulley arrangement of the system in accordance with a preferred embodiment.
Figure 8:
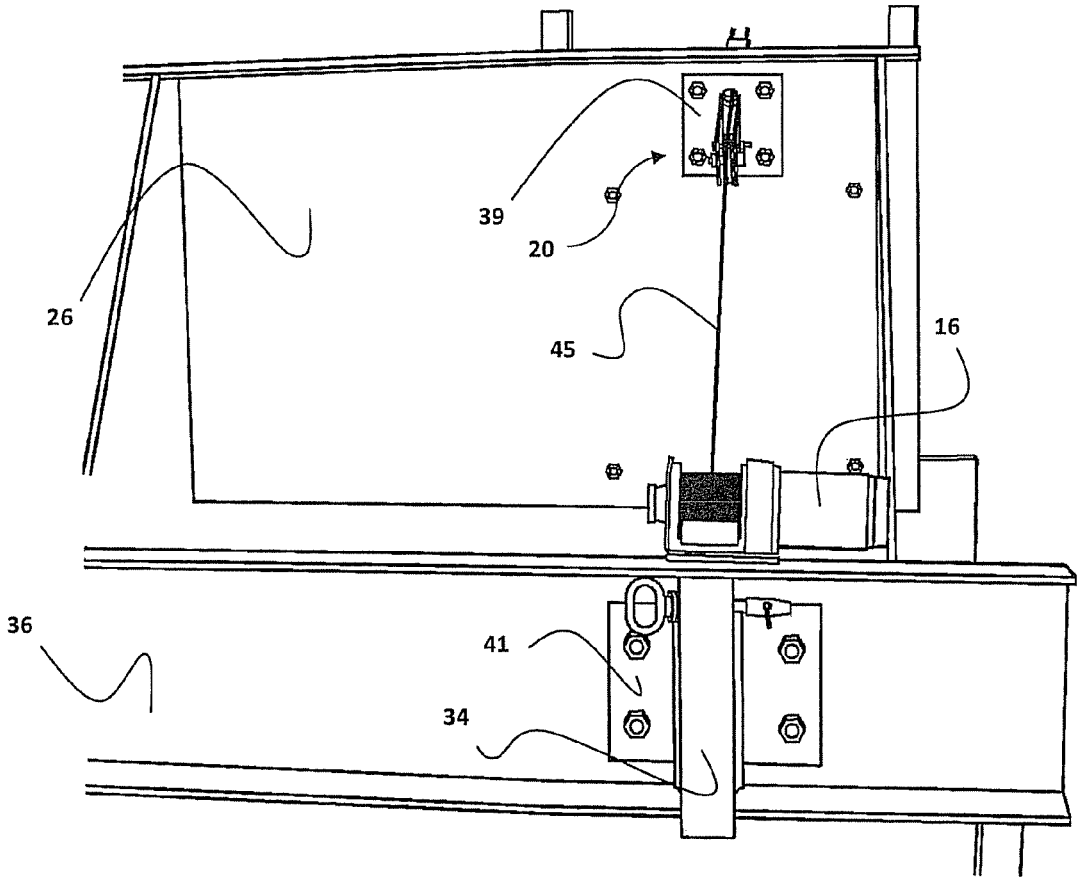
FIG. 8 is a winch side view showing the winch side pulley assembly, receiver, tube, and winch portions of the system in accordance with a preferred embodiment.
Figure 9:
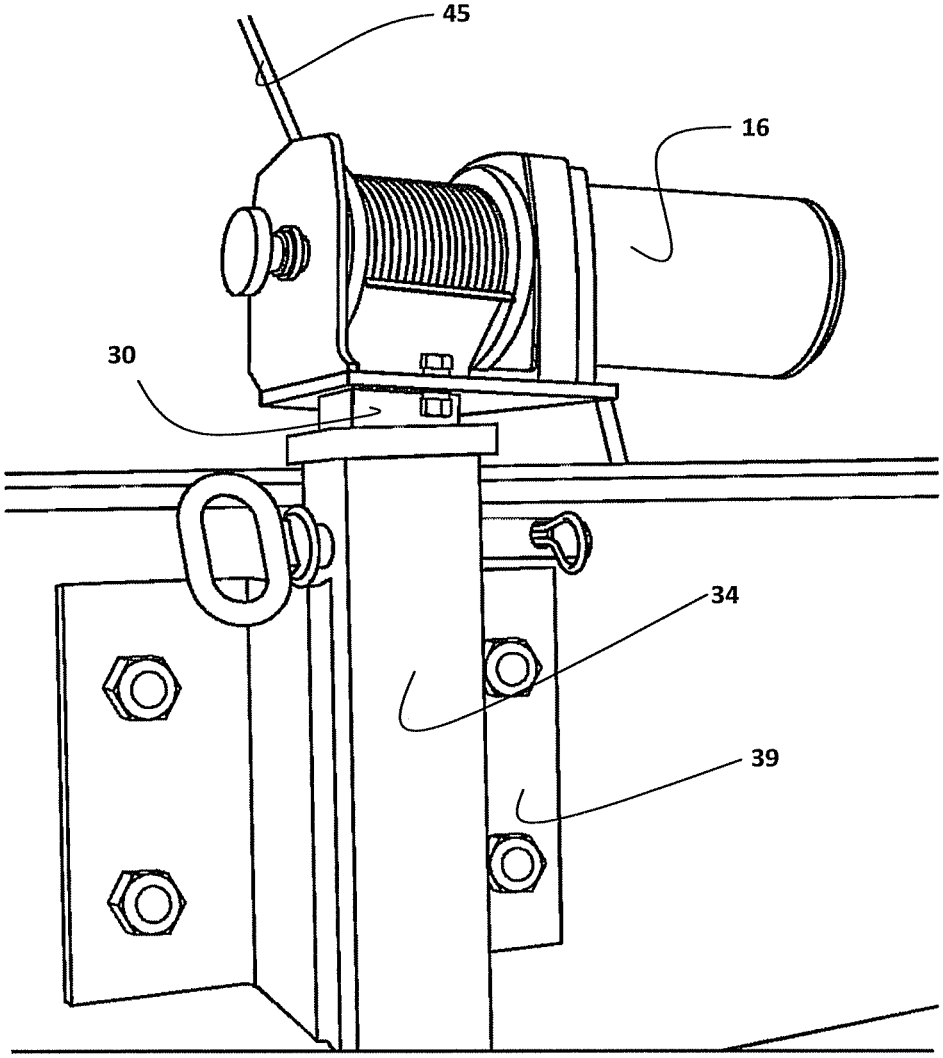
FIG. 9 is a left and rear isometric view showing the receiver, tube, and winch portions of the system in accordance with a preferred embodiment.
Figure 10:
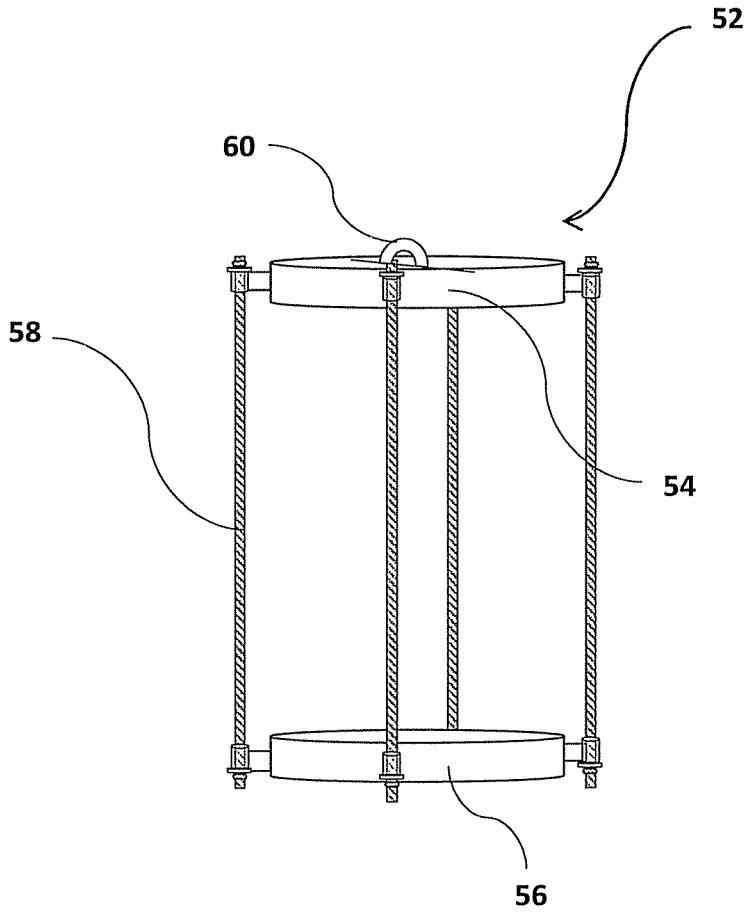
FIG. 10. is a side view of the cage which may be used to lift a motor, in accordance with a preferred embodiment.

As shown in FIG. 1, the cooler motor 44 is secured to a wall 24 of the cooler structure 26 with a motor plate 37. A substructure 36 is supported by the cooler structure 26. The receiver portion 34 is coupled to the substructure 36. In the preferred embodiment, a receiver mounting plate 39 is bolted to the substructure 36. The receiver portion 34 is welded to the mounting plate 39. Referring to FIG. 6, the cooler structure 36 may comprise limited access above the motor 44. For example, such limited access may be the result of a cover 72 or some other impediment that prevents convenient access to the motor 44.

A first pulley assembly 20 is mounted to an outside wall 24O of the structure 26. The first pulley assembly comprises a pulley mounting plate 41, pulley sides 43 and a pulley wheel 45 mounted on an axle 17 spanning between said pulley sides 43. The first pulley assembly 20 pulley sides 43 and a pulley wheel 45 extend downward from the outside wall 230 at approximately a 45 degree angle. A second pulley assembly 22 is mounted to an inside wall 24I of the structure 26. The second pulley assembly 22 comprises a pulley mounting plate 41, a pulley lifting arm 38 comprising pulley sides 43 and a pulley wheel 45 mounted on an axle 17 spanning between said pulley sides 43. The pulley lifting arm 38 extends from the inside wall 23O at approximately the same angle as the first pulley assembly 20, or approximately a 45 degree angle such that the first and second pulley wheels 45 are in general alignment with one another. The second pulley wheel 45 is positioned at an end of a lifting arm 38.

A through opening 40 (see FIG. 7) is provided in the wall 24 between the two pulley assemblies 20, 22 such that a winch cable 42 may be threaded from the winch 16 outside the structure 26, through the first pulley 20, through the wall opening 40, and over said second pulley 22. An end 44 of the cable 42 may be secured to the motor 44 in the interior 46 of said structure 26.

The winch 16 of the lifting system 14 is mounted to a tube assembly 28. This tube assembly 28 comprises a tube 30 and winch plate 32. The tube 30 is an elongated piece of square tubing material comprising, when viewed from an end, a generally square outside configuration. In the preferred embodiment, the tube 30 is approximately fourteen (14) inches in length and comprises four generally equal width (approximately 2 inch) sides 31 formed from ¼ inch steel. The receiver portion 34 is a formed from a generally square tubing material comprising an inside diameter slightly larger than an outside diameter of the tube 30 such that a first tube end 33 may be slideably and removably inserted within the receiver portion 34. The tube 30 comprises a winch plate 32 perpendicularly mounted to a second tube end 35. The winch plate 32 is adapted to be coupled to the winch 16. In this configuration, the tube assembly 28, together with the winch 16 may be removed from the receiver portion 34 when not in use. The tube assembly 28 and winch 16 may also be used in another system 14.

Figure 11:
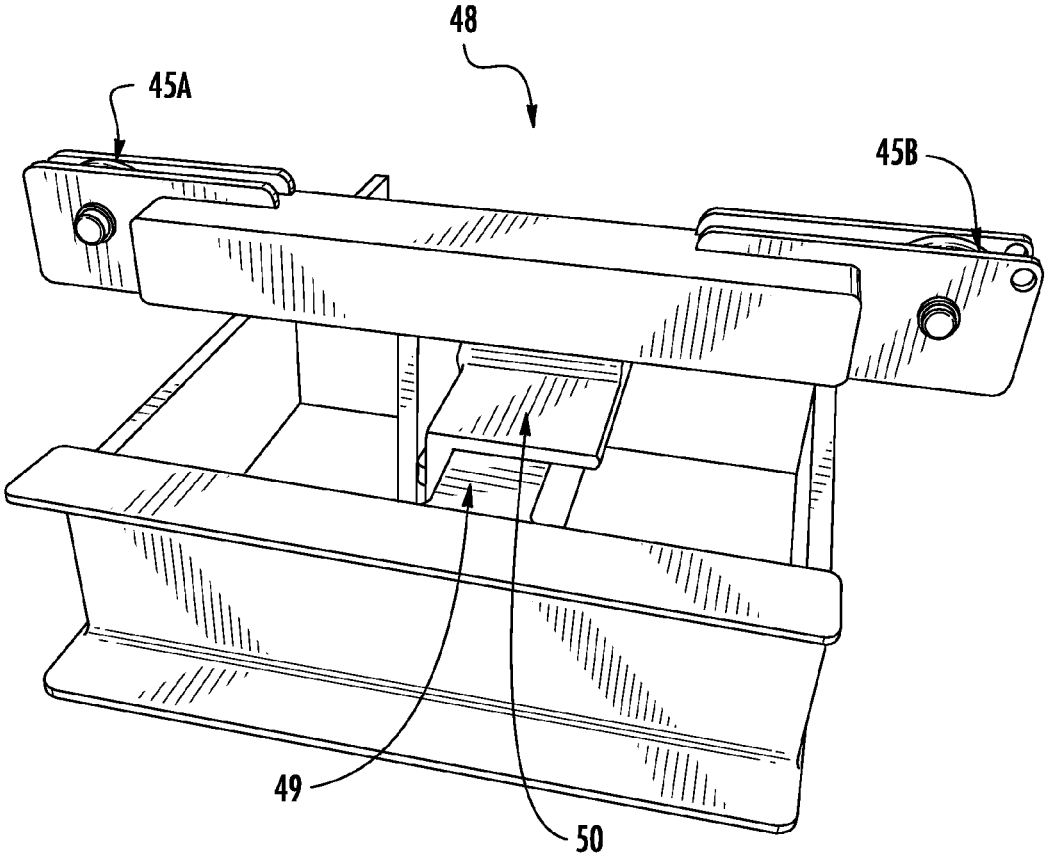
FIG. 11 is a side view of an alternative embodiment of the pulley system of the present invention.

Referring to FIG. 11, in another embodiment, the lifting system 14 is adapted for use in structures 26 that have reduced clearances in which the pulley system 18 described above cannot be readily mounted to the opposing surfaces of the wall 240, 24I. In this embodiment, the lifting system 14 comprises a horizontal member 48 and a coupling adaptor 50. The first and second pulley assemblies 20, 22 are mounted within this horizontal member 48 such that the sides 43 of the first pulley assembly 20 are also the sides 43 of the second pulley assembly 22. The horizontal member 48 spans, or straddles the wall such that the first pulley wheel 45 is positioned in an outer area 49 above the wall 24 and the second pulley wheel 45 is positioned in an inner area 51 above the wall 24. The horizontal member 48 extends generally perpendicularly from the top of the wall 24 such that the horizontal member 48 is generally parallel to the surface of the earth and a substructure base 47. The horizontal member 48 is secured to the coupling adapter 50. The coupling adapter 50 is bolted to the inside wall 24I as shown in FIG. 11. In the preferred embodiment, the wall 24 comprises an arcuate upper edge 49. However, the wall 24 need not comprise an arcuate upper edge 49. Rather, the system 14 may be installed in structures having straight edged walls 24 or walls 24 comprising angled upper portions without departing from the scope and spirit of the invention.

A method of removing a motor 44 from within a limited access space 26 is provided. In a preferred embodiment, the method comprises the steps of providing a lifting system 14 comprising a winch 16, a tube assembly 28 comprising a tube 30 and winch plate 32 and pulley system 18, the pulley system 18 comprising pulley assemblies 20, 22 adapted to be mounted to a wall 24 of a structure 26, the winch 16 being mounted to the winch plate 32, the tube 30 being slideably and removably coupled to a receiver portion 34 such that the tube assembly 28 may be removed when not in use or may be moved to be used in another system 14; wherein said receiver portion 34 is coupled to a substructure 36 of the structure 26; wherein, the first pulley assembly 20 is mounted to an outside wall 24I of said structure 26; wherein the second pulley assembly 22 comprises a lifting arm 38, said second pulley assembly 22 being coupled to an inside wall 24I of the structure 26; wherein a through opening 40 is provided in said wall 24 so that a winch cable 42 may be threaded from the winch 16 outside the structure 26, through a wheel 45 of the first pulley assembly 20, through said wall opening 40, and over said second pulley assembly 22; threading said cable 42 through said first pulley assembly 20 and opening 40 and over said second pulley assembly 22; securing the cable 42 to the motor 44; activating the winch 16 such that the motor 44 is partially lifted; detaching from the wall 24 a motor support bracket 37 that secures the motor 44 to the wall 24; and further lowering the motor 44 and motor support bracket 37 so that it can be moved outside the structure 26.

A method for replacing a motor 44 from within a limited access space 26 is provided. In a preferred embodiment, the method comprises the steps of providing a lifting system 14 comprising a winch 16, a tube assembly 28 comprising a tube 30 and winch plate 32 and pulley system 18, the pulley system 18 comprising pulley assemblies 20, 22 adapted to be mounted to a wall 24 of a structure 26, the winch 16 being mounted to the winch plate 32, the tube 30 being slideably and removably coupled to a receiver portion 34 such that the tube assembly 28 may be removed when not in use or may be moved to be used in another system 14; wherein said receiver portion 34 is coupled to a substructure 36 of the structure 26; wherein, the first pulley assembly 20 is mounted to an outside wall 24O of said structure 26; wherein the second pulley assembly 22 comprises a lifting arm 38, said second pulley assembly 22 being coupled to an inside wall 24I of the structure 26; wherein a through opening 40 is provided in said wall 24 so that a winch cable 42 may be threaded from the winch 16 outside the structure 26, through a wheel 45 of the first pulley assembly 20, through said wall opening 40, and over said second pulley assembly 22; threading said cable 42 through said first pulley assembly 20 and opening 40 and over said second pulley assembly 22; securing the cable 42 to the motor 44; activating the winch 16 such that the motor 44 is partially lifted; detaching from the wall 24 a motor support bracket 37 that secures the motor 44 to the wall 24; and further lowering the motor 44 and motor support bracket 37 so that it can be moved outside the structure 26; removing the motor from the motor support bracket 37; coupling a replacement motor 44 to the motor support bracket 37; and coupling said motor support bracket 37 together with said replacement motor 44 to the wall 24I using the winch 16.

In another embodiment, the method of removing a motor 44 from within a limited access space 26 comprises the steps of providing a lifting system 14 comprising a horizontal member 48 and a coupling adaptor 50; the horizontal member 48 comprising first and second pulley assemblies 20, 22 comprising first and second pulley wheels 45A, 45B; coupling said horizontal member 48 to an upper portion of a wall of a structure 26 such that said horizontal member 48 spans above said wall and said first pulley wheel 45A is positioned exterior to the wall 24 and the second pulley wheel 45B is positioned interior to the wall 24 such that the horizontal member 48 extends generally perpendicularly from the top of the wall 24 and generally parallel to the surface of the earth and a substructure base 47; the horizontal member 48 being secured to the coupling adapter 50; wherein said receiver portion 34 is coupled to a substructure 36 upon which the structure 26 is mounted; threading a cable 42 through said first pulley wheel 45A and over the second pulley wheel 45B; securing the cable 42 to the motor 44; activating the winch 16 such that the motor 44 is partially lifted; removing a motor support bracket 37 that secures the motor 44 to the wall 24; and further lowering the motor 44 so that it can be moved outside the structure 26.

In another embodiment, the method of replacing a motor 44 from within a limited access space 26 comprises the steps of providing a lifting system 14 comprising a horizontal member 48 and a coupling adaptor 50; the horizontal member 48 comprising first and second pulley assemblies 20, 22 comprising first and second pulley wheels 45A, 45B; coupling said horizontal member 48 to an upper portion of a wall of a structure 26 such that said horizontal member 48 spans above said wall and said first pulley wheel 45A is positioned exterior to the wall 24 and the second pulley wheel 45B is positioned interior to the wall 24 such that the horizontal member 48 extends generally perpendicularly from the top of the wall 24 and generally parallel to the surface of the earth and a substructure base 47; the horizontal member 48 being secured to the coupling adapter 50; wherein said receiver portion 34 is coupled to a substructure 36 upon which the structure 26 is mounted; threading a cable 42 through said first pulley wheel 45A and over the second pulley wheel 45B; securing the cable 42 to the motor 44; activating the winch 16 such that the motor 44 is partially lifted; removing a motor support bracket 37 that secures the motor 44 to the wall 24; further lowering the motor 44 so that it can be moved outside the structure 26; and replacing the motor 44 with a replacement motor 44 using the winch 26 in a reverse sequence used in removing the motor 44.

Figure 4:
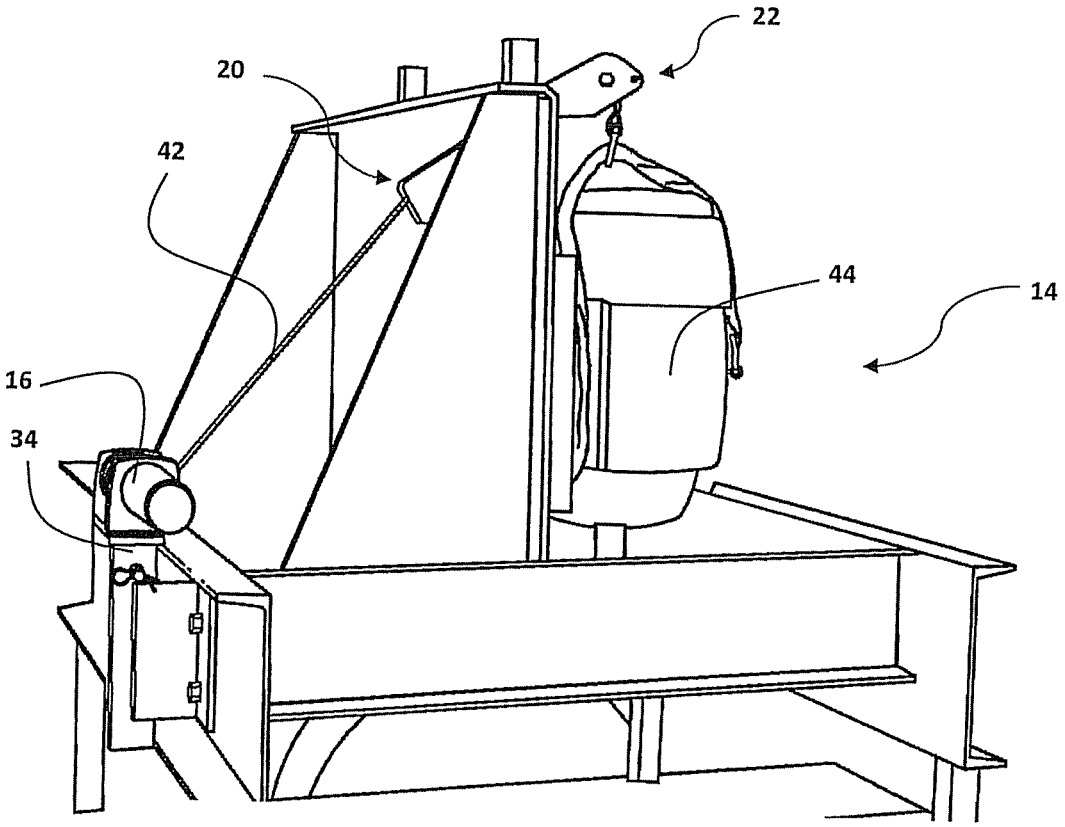
FIG. 4 is a side and winch side view of the system showing the motor suspended by the cable in accordance with a preferred embodiment.
Figure 5:
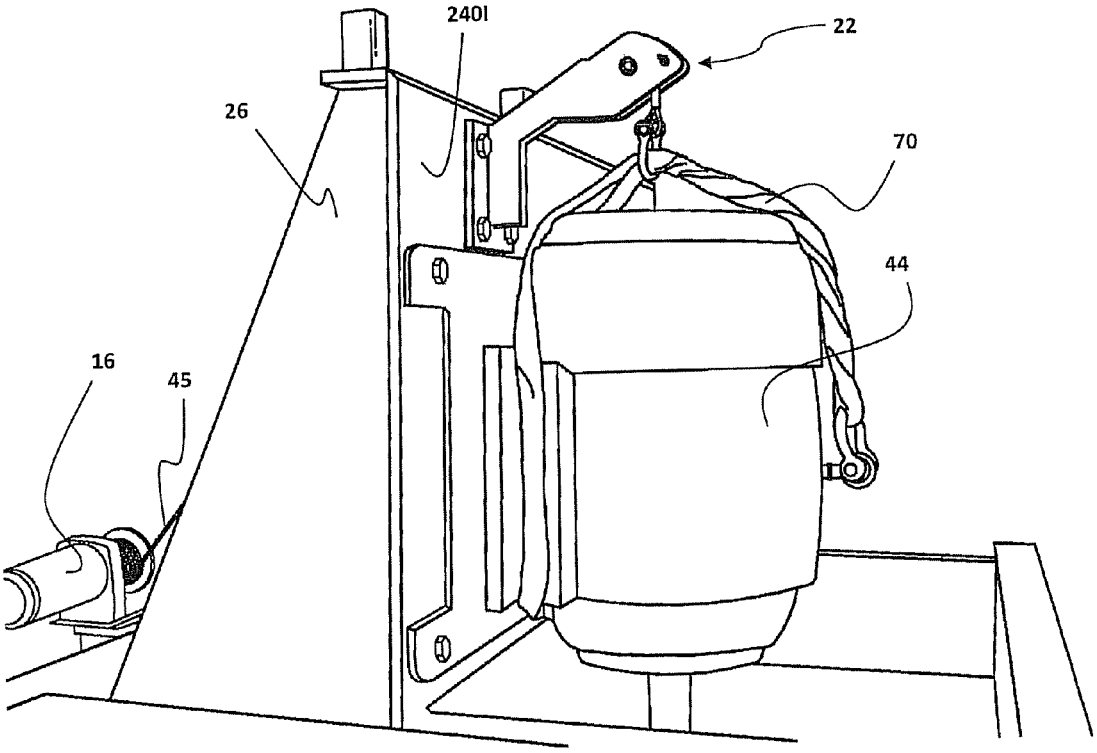
FIG. 5 is a side and motor side view of the system showing a portion of the system with the motor attached to the cable in accordance with a preferred embodiment.

In FIGS. 4-6, the lifting system 14 is shown lifting the motor with a sling apparatus 70. This sling 70 is generally wrapped around the motor and lifted, together with the motor 44, by the winch 16 and cable 42. However, lifting the motor 44 with the sling 70 can sometime result in the motor 44 coming loose. Therefore, to provide a more secure structure with which to lift the motor 44, in other embodiments, a lifting cage 52 is provided. The cage 52 comprises upper 54 and lower retaining portions 56, sides 58, and a connector portion 60. The sides 58 span between the upper 54 and lower 56 portions. The cage 52 is adapted to be removably coupled to the motor 44. The motor 44 may be supported by lifting the cage 44 with the connector portion 60.

In one embodiment the cage 52 side portions 58 comprise a plurality of rods 62. In the preferred embodiment, these rods 62 are threaded rods 62 which permit the cage 52 to be adjusted for motors 44 of different dimensions.

In one embodiment a motor stand 64 is provided. The motor stand 64 comprises a back 66 and a base 68.

The foregoing disclosure and showings made in the drawing are merely illustrative of the principles of this invention and are not to be interpreted in a limiting sense. While the invention is shown in only a few forms, it is not just limited to the forms shown, but is susceptible to various changes and modifications without departing from the spirit thereof. The foregoing description of a preferred embodiment of the invention has been presented for the purpose of illustration and description. It is not intended to be exhaustive or to limit the invention to the precise form disclosed. Obvious modifications or variations are possible in light of the above teachings. The invention may be adapted for use in a number of environments.

The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention in accordance with the breadth of this disclosure, to which it is fairly, legally, and equitably entitled to be interpreted.

I claim:

1. A lifting system comprising a winch and pulley system, the pulley system comprising first and second pulley assemblies adapted to be mounted to a wall of a structure, said first pulley assembly being coupled to an outside surface of the wall of said structure, said second pulley assembly being coupled to an inside surface of said wall, the wall comprising a through opening through which a winch cable may be threaded.

2. The lifting system of claim 1 further comprising a rube assembly and a receiver portion, the tube assembly comprising a tube and winch plate, the winch being mounted to said winch plate, the tube being slideably and removably coupled to the receiver portion; said receiver portion being coupled to the structure.

3. The lifting system of claim 2, said structure comprising an outer area and an inner area, said winch being positioned in said outer area, said winch cable extending from the winch over a wheel of the first pulley assembly, through said wall opening, and over a wheel of said second pulley assembly, and into the inner area.

4. A lifting system comprising a winch, a horizontal member, and a coupling adaptor, the horizontal member comprising first and second pulley wheels, said horizontal member being coupled to an upper portion of a wall of a structure, said structure comprising an outer area and an inner area, the horizontal member spanning above said wall, said first pulley wheel being positioned in the outer area, the second pulley wheel being positioned in the inner area, and the horizontal member being secured to the coupling adapter.

5. The lifting system of claim 4 further comprising a tube assembly and a receiver, the tube assembly comprising a tube and winch plate, the winch being mounted to said winch plate, the tube being slideably and removably coupled to the receiver; said receiver being positioned in said outer area.

6. The lifting system of claim 5, said winch comprising a winch cable, said winch cable extending from the winch over the first pulley wheel and over said second pulley wheel.

7. A method of removing a motor from a wall of a structure comprising the steps of:

providing a winch and pulley system, the pulley system comprising first and second pulley assemblies adapted to be mounted to the wall, said first pulley assembly being coupled to an outside surface of the wall, said second pulley assembly being coupled to an inside surface of said wail, the wall comprising a through opening through which a winch cable may he threaded;

threading said cable over a wheel of said first pulley assembly, through the opening, and over said second pulley assembly;

securing the cable to the motor;

activating the winch such that the motor is partially lifted;

detaching the motor from the wall; and lowering the motor.

8. A method of removing a motor from a wall of a structure comprising the steps of:

providing a winch and pulley system, the pulley system comprising first and second pulley assemblies adapted to be mounted to the wall, said first pulley assembly being coupled to an outside surface of the wall, said second pulley assembly being coupled to an inside of the wall, the wall comprising a through opening through which a winch cable may be threaded;

threading said cable over a wheel of said first pulley assembly, through the opening, and over said second pulley assembly;

securing the cable to the motor;

detaching the motor from the wall;

lo wring the motor;

coupling a replacement motor to the cable;

raising the replacement motor; and coupling the replacement motor to the wall.

9. The method of claim 8 further comprising the step of:

providing a lifting cage, the lifting cage comprising a lower retaining portion, sides, and a connector portion; the sides spanning between said upper and lower portions.

10. The method of claim 9, after the step of lowering the motor, the step of:

positioning said motor on a motor stand.

11. A method of removing a motor from a wall of a structure comprising the steps of:

providing a winch, a horizontal member, and a coupling adaptor, the horizontal member comprising first and second pulley wheels, said horizontal member being coupled by the coupling adaptor to an upper portion of the wall, said structure comprising an outer area and an inner area, the horizontal member spanning above said wall, said first pulley wheel being positioned in the outer area, the second pulley wheel being positioned in the inner area;

threading a cable through said first pulley wheel and over the second pulley wheel;

securing the cable to the motor; and lowering the motor.

12. The method of claim 11 further comprising the step of:

providing a lifting cage, the lifting cage comprising a lower retaining portion, sides, and a connector portion; the sides spanning between said upper and lower portions.

13. The method of Claim 12, after the step of lowering the motor, the step of:

positioning said motor on a motor stand.

14. A method of replacing a motor from a wall of a structure Comprising the steps of:

providing a winch, a horizontal member, and a coupling adaptor, the horizontal member comprising first and second pulley wheels, said horizontal member being coupled by the coupling adaptor to an upper portion of the wall, said structure comprising an outer area and an inner area, the horizontal member spanning above said wall, said first pulley wheel being positioned in the outer area the second pulley wheel being positioned in the inner area;

threading a cable through said first pulley wheel and over the second pulley wheel;

securing the cable to the motor;

detaching the motor from the wall;

lowering the motor;

coupling a replacement motor to the cable;

raising the replacement motor; and coupling the replacement motor to the wall.

15. The method of claim 14 further comprising the step of:

providing a lifting cage, the lifting cage comprising a lower retaining portion, sides, and a connector portion; the sides spanning between said upper and lower portions.

16. The method of claim 15, after the step of lowering the motor, the step of:

positioning said motor on a motor stand.

* * * * *